US008517631B1

(12) United States Patent
Ross et al.

(10) Patent No.: US 8,517,631 B1
(45) Date of Patent: Aug. 27, 2013

(54) SHORELINE EROSION MITIGATION DEVICE

(75) Inventors: Gary Ross, Oxnard, CA (US); Stan Pleskunas, Watsonville, CA (US)

(73) Assignee: Highwave, Inc., Oxnard, CA (US)

( * ) Notice: Subject to any disclaimer, the term of this patent is extended or adjusted under 35 U.S.C. 154(b) by 149 days.

(21) Appl. No.: 12/661,086

(22) Filed: Mar. 9, 2010

(51) Int. Cl.
*E02B 3/04* (2006.01)

(52) U.S. Cl.
USPC ..... 405/25; 405/21; 405/23

(58) Field of Classification Search
USPC ..... 405/15, 21, 23, 25, 27, 30, 35, 302.4, 405/302.6; 138/106, 111, 112, 113; 114/266, 114/267; 441/133, 134; 24/298, 300, 301, 24/335; 403/385, 386, 397, 398, 289, 290; 472/128
See application file for complete search history.

(56) References Cited

U.S. PATENT DOCUMENTS 4,027,486 A * 6/1977 Dougherty ..... 405/27
5,207,531 A 5/1993 Ross

* cited by examiner

*Primary Examiner* — Sean Andrish
(74) *Attorney, Agent, or Firm* — Thomas I. Rozsa

(57) ABSTRACT

A shoreline erosion mitigation device placed in a body of water including a multiplicity of high density polyethylene pipes each of a given length and diameter with each pipe being generally cylindrical in shape and having a hollow interior, the multiplicity of high density polyethylene pipes arranged in approximately parallel rows with adjacent pipes connected together by a system using clamps and flexible links, which leaves a space between adjacent pipes so that by increasing or decreasing the number, length and/or diameter of the pipes and/or the number of clamps, the design of the device is adjusted to accommodate differing shoreline conditions. When a wave having a given force traveling from the body of water towards the shoreline encounters the device, the force of the wave is reduced by causing the water to travel over the device and through the spaces between adjacent pipes before reaching the shoreline.

25 Claims, 10 Drawing Sheets

SHORELINE EROSION MITIGATION DEVICE

BACKGROUND OF THE INVENTION

1. Field of the Invention

The present invention relates to the field of apparatus used to modify the impact of waves as they wash ashore and diminish the impact of the waves in eroding beaches and other shoreline property. Diminishing beaches due to wave action and/or current erosion and lack of sediment replenishment from rivers are the primary cause of the threat to shoreline structures from storm tides, currents and wave action.

2. Description of the Prior Art

Historically, artificial reefs have been used to some degree of success in mitigating wave and tidal damage to shoreline structures. However, artificial reefs are typically extremely expensive to build and have short life spans.

Artificial reefs typically encourage ocean waves to expend their energy by breaking offshore, thereby reducing the impact of wave energy on the shoreline. Artificial reefs can be used to encourage sediment accretion in specific areas although present art is inexact for this purpose.

Present art used in the design and construction of artificial reefs almost universally incorporate monolithic design features. These include geo-textile sand bags, sunken boats or ships, rip rap or dredged materials.

Existing Art:

Weight, Buoyancy, Permeability and Flexibility:

Weight:

Present art depends on mass to keep an artificial reef in place. Massive weight requires unnecessary effort and cost in the form of material expense and handling costs. Massive weight also becomes a liability on sand or mud bottoms. The nature of sand and mud bottoms can best be described as solid fluids. Any device or object placed on the sea floor which has greater density than the "fluidized solid" bottom will eventually sink. This is one of the most common failures in artificial reefs using present art. Conversely, any device or object which has a density less than the "fluidized solid" bottom will "float" indefinitely.

Surface Area:

Monolithic structures by nature have relatively small surface areas relative to weight. Relatively small surface area decreases the overall effect on wave formation, littoral current dissipation and energy absorption, all of which require large surface areas.

Monolithic, small area structures used in the present art have an inability to disperse or absorb energy acting on the structure in the form of waves and/or currents. Littoral currents (currents moving parallel to shore) represent the main force that moves sediment and produces scouring along objects on the sea floor. Monolithic structures are able to redirect a current's energy. The result of energy re-direction is a change in speed and direction of current movement along with the sediment it carries. This is contrary to the ideal result which is: current energy absorption and sediment accretion within the reef structure.

Permeability:

Present artificial reef art with its monolithic nature and relatively small surface areas are not permeable. They do not let currents carrying sediment pass through the structure. Monolithic structures tend to redirect and increase the speed of littoral currents which allow them greater sediment carrying capacity. This result is directly contrary to the desired effect which is to encourage sediment accretion in specific areas especially within the reef's structure.

Flexibility:

Present art using monolithic structures depending on mass and relatively small surface areas are designed to redirect energy rather than absorb it. These are typically rigid structures subject to concentrated loads or forces. Nature demonstrates that flexibility is a key quality for energy absorption and structure longevity in an ocean environment. Present art does not include this key quality.

One of the present inventors, Gary Ross, is the inventor of the "Artificial Surfing Reef" which was patented on May 4, 1993 and assigned U.S. Pat. No. 5,207,531. The purpose of that invention was to create surfing waves. The invention included stacked groups of elongated pipes.

There is a significant need for an improved structure which will serve to modify the impact of waves as they wash ashore and diminish the impact of the waves in eroding beaches and other shoreline property.

SUMMARY OF THE INVENTION

The present invention is a submerged apparatus which has a top surface that rests a few feet below the surface of the ocean and serves to impact waves as they come ashore to dissipate the wave energy and impact the direction of flow of the waves to diminish the impact of the waves as they come ashore.

The present invention is a cost effective, ecologically sound, shoreline erosion mitigation device in the form of an artificial reef.

This new artificial reef art demonstrates the ability to:

(1) reduce or eliminate wave energy impact on shorelines;

(2) reduce or eliminate sediment transport via littoral current;

(3) encourage sediment accretion in specific areas create; and (4) protect shoreline structures from ocean erosion.

The preset invention new reef features:

(1) modular construction;

(2) buoyancy;

(3) flexibility;

(4) scalability;

(5) permeability; and (6) portability.

Each of the above features will now be more particularly described.

(1) Modular Construction:

The new art's main element consists of lengths of high density polyethylene (HDPE) pipe. Polyethylene is an inexpensive, inert plastic with natural toughness and flexibility which will not corrode or deteriorate in an ocean environment. High density polyethylene pipe is commonly used for dredging and oil transmission lines.

In the present invention, HDPE pipes are arranged in approximately parallel rows and connected by a system using clamps and flexible links which leaves space between the pipes. By increasing or decreasing the number, length and/or diameter of the pipes and/or the number of clamps, the design of the reef can be adjusted to accommodate differing bathymetrics and conditions. This modular nature allows this reef design to be easily scaled and engineered to meet virtually any location's requirements.

The fact that HDPE pipe is manufactured around the world and the universal nature of the clamp design insure low cost through economy of scale and ease of manufacture.

(2) Buoyancy:

The ability to adjust the buoyancy of this new artificial reef is key to the benefits of this new art. The major element is HDPE pipe which floats with open ends. This allows material such as sand or aggregate to be added as ballast within the HDPE pipes to decrease buoyancy and vastly increase weight. With the ends of the pipes closed and pipes empty, buoyancy increases dramatically.

It is now possible to adjust the overall and/or specific pipe buoyancy by adding or withholding material within the pipes. This allows adjustment of buoyancy to insure reef structure stability and longevity. The buoyancy could be varied in several ways. At least one or more of the HDPE pipes can be filled entirely with air, at least one or more of the HDPE pipes can be filled entirely with ballast or sand, or at least one or more of the HDPE pipes can be partially filled with air and partially filled with ballast such as sand.

(3) Construction Procedure:

During the construction phase of this reef all pipes will be fitted with closed ends to create the maximum amount of buoyancy. Connecting clamps would be installed in calm water within a harbor. In this initial assembly phase, the assembled reef would look like a log/pipe raft with most or all pipe elements floating on the water's surface. The ability to "float" the pipes into position during the construction phase, in protected water, greatly reduces material handling costs. Assembly of the reef in a controlled environment such as a harbor also greatly reduces construction impacts on environmentally fragile shoreline locations.

Once assembly is complete, the reef "raft" is towed to location.

The instillation phase includes placing anchors or fastening points to the bottom, positioning the floating reef assembly through the use of tugs and temporary lines or cables, attachment to fastening points and buoyancy adjustment.

Fastening point locations and buoyancy adjustment will determine the final cross sectional and plan form of the reef. These operations will take into consideration the bottom structure, waves and currents and other natural environmental factors Buoyancy variability simplifies construction, transport and placement of this new reef. Inexpensive assembly, materials, standardized fastening system and shape adjustability insure efficacy with remarkably low cost and quick, low impact construction.

(4) Flexibility:

The inherent flexibility of HDPE pipe and the flexibility built into the pipe connection system allow the individual elements and complete assembly to absorb/react to the forces exerted on it in the ocean environment. The flexibility and modularity of the connecting clamps allow the entire structure to share the forces acting upon it. This "load sharing" is a key quality of the new reef structure. Highly concentrated loads such as a wave breaking on the reef structure are dispersed throughout the structure by virtue of the bending of the HDPE pipe and the elongation and compression of the flexible linking elements. The nature of the design of the connecting clamps adds hoop strength to the HDPE pipes at the connection points. This reduces the tendency of a pipe to collapse or flatten under bending loads. Inclusion of connecting links of various shapes and/or lengths and/or compression struts between pipes and the natural HDPE pipe's flexibility allows manipulation of the pipe elements to non-linear or curved forms. This ability greatly increases design adaptability to location and conditions as well as overall strength.

(5) Scalability:

It is known that in order to encourage ocean waves to break, the size of an artificial reef is critical. In general the larger the reef, the more control over wave action any design will have. The ability to cost effectively add to the size and/or modify the shape of an artificial reef vastly increases its potential to control or modify ocean waves. The modular design of this reef makes it intrinsically scalable. Scalability increases efficacy and also intrinsically lowers cost during both the design and construction phases.

(6) Permeability:

Permeability is a fundamental element of this new art. The principal this new reef utilizes is similar to that of a snow or sand fence. The flow of wind carrying sand or snow is slowed down and redirected by a "permeable" fence to encourage accretion of snow or sand around the fence. Reef permeability and shape of the pipe elements in this new reef structure function in much the same way.

Permeability is achieved by fastening HDPE pipes together with a space between them. Permeability offers the advantage of increased surface area not directly exposed to ocean forces. This means any force acting on the structure is dispersed over a larger area equating to lower force per unit area.

The circular cross section of pipe tends to disperse or redirect forces from any given vector. Flow around a pipe slows down as it passes the pipe and changes direction to random vectors. Sediment carried in the decreasing flow precipitates or falls to the ocean bottom within the reef structure.

A primary function of this new art is to accrete sediment within its structure. Sediment accretion adds to the stability of the reef structure and its effectiveness to encourage ocean waves to break offshore.

In locations where sand is not available for accretion the reef's permeability and cylindrical pipe form elements are used primarily for energy absorption and distribution throughout the structure. Without permeability effective sand accretion and efficient load sharing would not be possible.

(7) Portability:

As described above, portability facilitates construction, transport and placement of the new reef. An additional benefit of this portable reef design is that it can be easily removed or relocated. The ability to increase buoyancy by removing sand ballast from within the pipes or simply adding air into specific pipes adjacent any pipes committed with permanent ballast, through the use of pumps, allows the entire structure to be re-floated and moved. A beach can be widened or "built" by simply moving the reef structure a short distance farther seaward as sediment accretes within the structure.

Portability also allows quick reef instillation to protect threatened structures during emergencies.

The design elements of this structure are not limited to ocean shoreline protection. The features and functions of this design can be used to mitigate erosion of river banks, levies, canals or any other body of water subject to shoreline erosion due to waves and/or current.

(8) Comments on Reef Plan Forms and Cross Section Shapes:

Any given location will have its own requirements for shore line erosion mitigation. The modular nature of this design allows virtually any size or shape of reef to be designed to create the desired effect. Suggested plan forms might be "Y' shaped to encourage certain wave forms. Plan forms can be rectangular, triangular or crescent in shape. Non-linear or non-geometric shapes are also possible plan forms. Cross sectional shapes can be anything from flat to circular to more organic or non-liner, non-geometric.

The design of fastening point grids in the ocean floor can be arranged to impart both plan form and cross sectional shape.

Cables and/or struts fastened between reef structure elements can be used to control shape and functional qualities.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
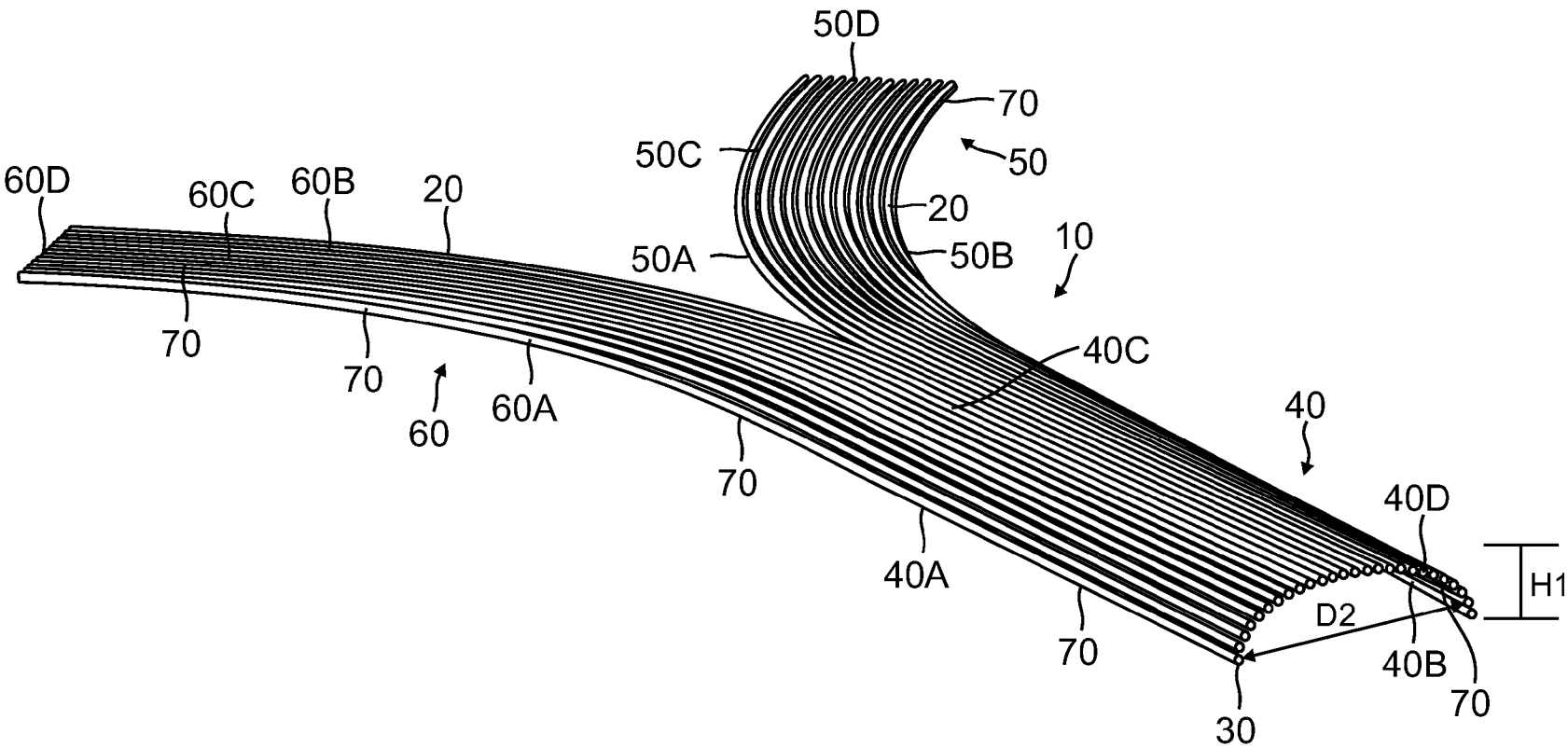
FIG. 1 is a perspective view of a preferred embodiment of the present invention shoreline erosion mitigation device.
Figure 2:
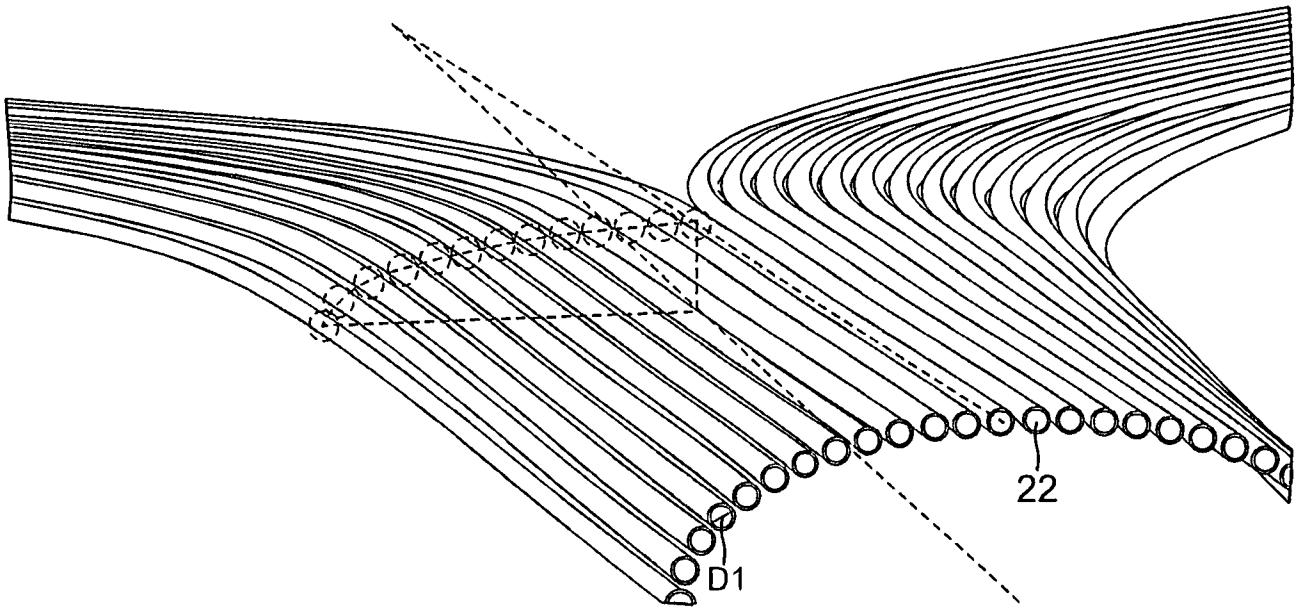
FIG. 2 is a close-up perspective view of a preferred embodiment of the present invention shoreline erosion mitigation device, showing the leading edge of the device in greater detail.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 4, there is illustrated a preferred embodiment of the present invention shoreline erosion mitigation device 10. The main element of the device 10 consists of lengths of high density polyethylene (HDPE) pipe 20. PE is an inexpensive, inert plastic with natural toughness and flexibility which will not corrode or deteriorate in an ocean environment. Polyethylene pipe is commonly used for dredging and oil transmission lines.

In the present invention 10, HDPE pipes 20 are arranged in approximately parallel rows 30 and connected by a system using flexible links or clamps 200 (see FIG. 7) which leaves space 120 between the pipes 20. By increasing or decreasing the number, length and/or diameter of the pipes 20 and/or the number of clamps 200, the design of the reef 10 can be adjusted to accommodate differing bathymetrics and conditions. This modular nature allows this reef design to be easily scaled and engineered to meet virtually any location's requirements.

The fact that HDPE pipe is manufactured around the world and the universal nature of the clamp design insure low cost through economy of scale and ease of manufacture.

Each pipe 20 has a diameter "D1" which can range from 12 inches to 26 inches. The preferred shape of each leg of the device 10 is arcuate, having a diameter D2 which can be 50 feet and a vertical height "H1" which can be 25 feet. In the preferred embodiment, the device or reef 10 has a leading leg section 40 which extends to a first divergent leg section 50 and a second divergent leg section 60. The sections are fastened to anchors 70 which are buried in the ocean sand. The lower edges 40A and 40B of leading leg section 40, and 50A and 50B of first divergent leg section 50 and 60A and 60B of second divergent leg section 60 are resting on the ocean floor and the top surface 40C, 50C and 60C of each section rest a few inches or a few feet below the water surface, depending on the slope of the beach.

In a preferred orientation, the front or leading edge 40D of leading leg section 40 is positioned so that it faces toward the open sea and away from the beach while the trailing edges 50D and 60D of the two divergent leg sections 50 and 60 are closest to the shoreline.

The ability to adjust the buoyancy of this new artificial reef 10 is key to the benefits of this new art. The major element is HDPE pipe 20 which floats with open ends. This allows material such as sand or aggregate to be added as ballast within the interior 22 of the HDPE pipes 20 to decrease buoyancy and vastly increase weight. With the ends of the pipes closed (as illustrated in FIG. 5) and pipes empty, buoyancy increases dramatically.

It is now possible to adjust the overall and/or specific pipe buoyancy by adding or withholding material within the pipes 20. This allows adjustment of buoyancy to insure reef structure stability and longevity.

Figure 5:
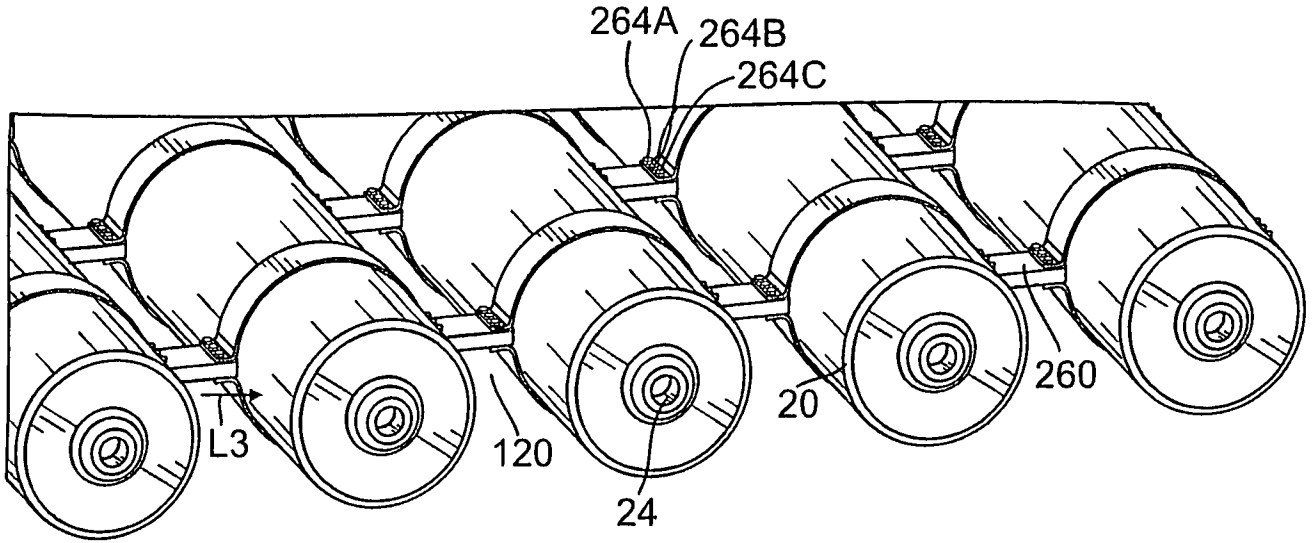
FIG. 5 is a close-up perspective view of an alternative embodiment of the present invention where the pipes are sealed.
Figure 6:
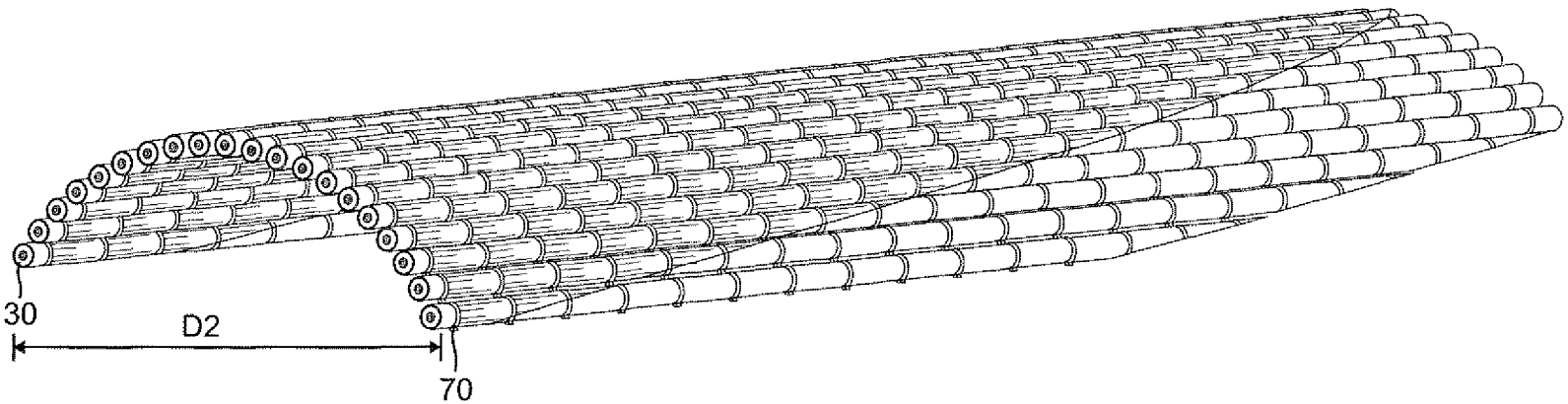
FIG. 6 is a top perspective view of a section of a preferred embodiment of the present invention shoreline erosion mitigation device, the dark color reef structure is above the grade and the light color reef structure is below the grade where the clamps are made of flexible links and the pipe is shown as polyethylene pipe.
Figure 7:
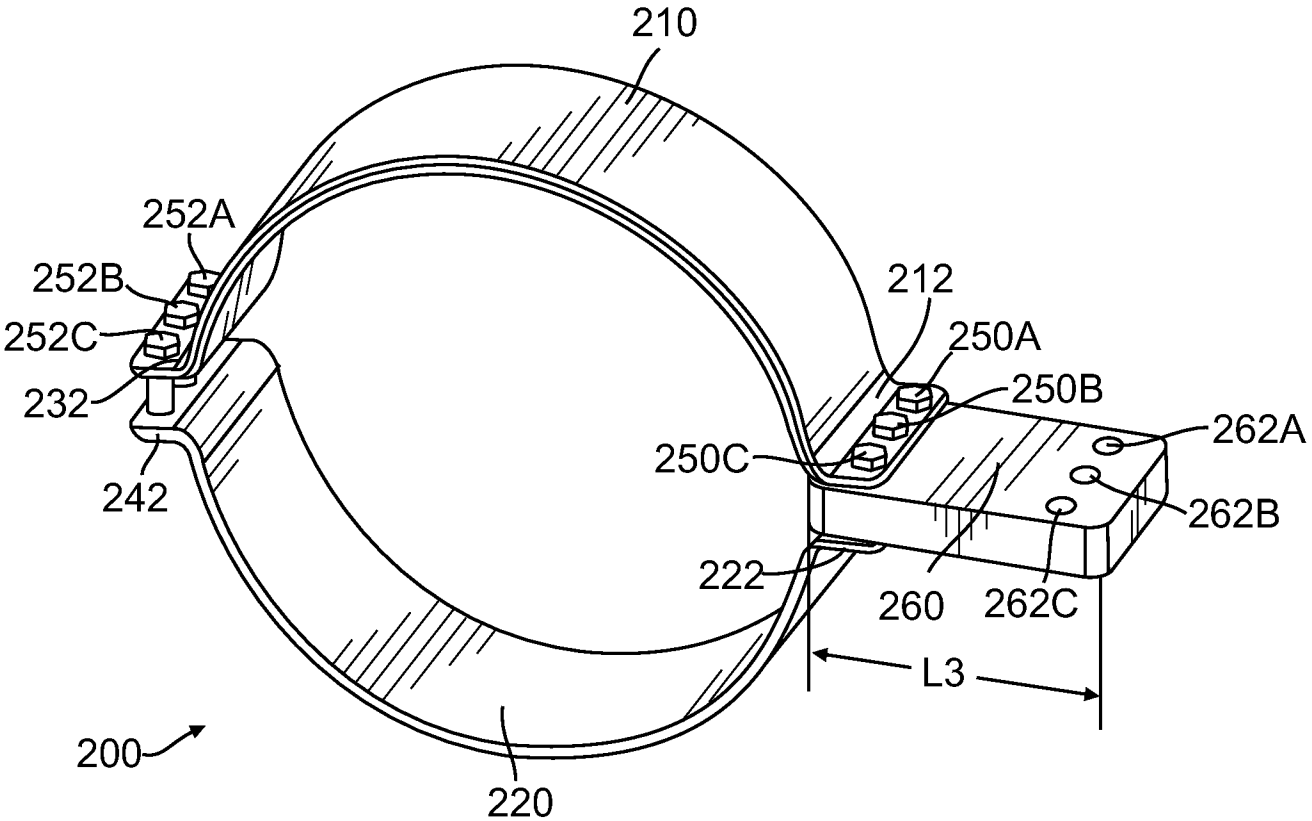
FIG. 7 is a perspective view of a fastening clamp used to connect two pipes together.
Figure 8:
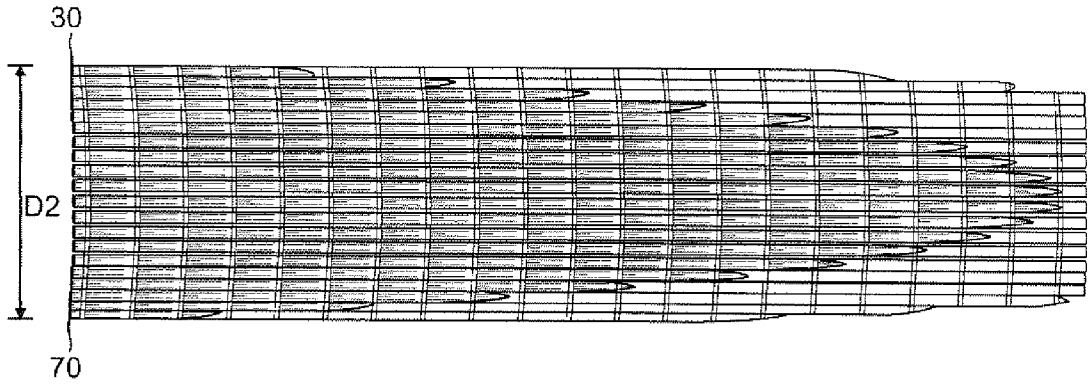
FIG. 8 is a top perspective view of a section of a preferred embodiment of the present invention shoreline erosion mitigation device after sand accretion has started on the structure.
Figure 9:
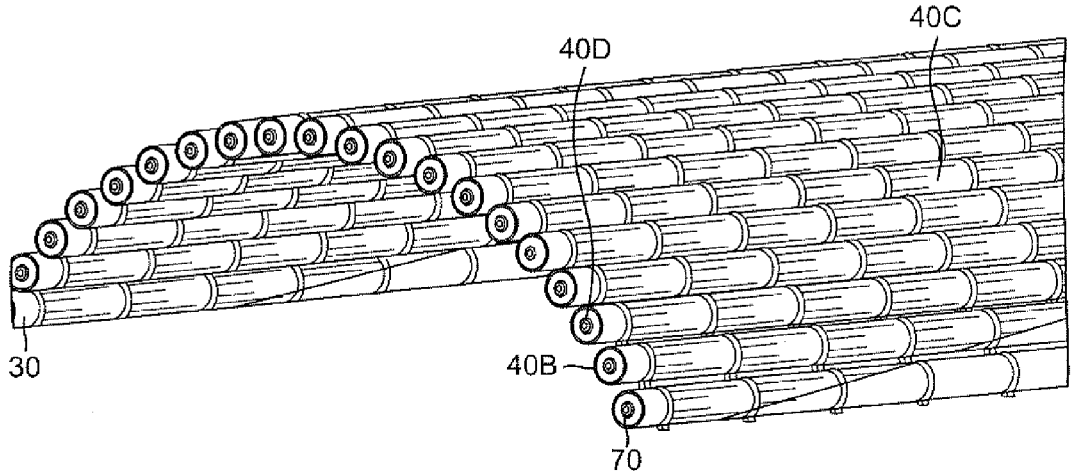
FIG. 9 is a front perspective view of a section of a preferred embodiment of the present invention shoreline erosion mitigation device, where the polyethylene pipe is shown, stainless clamps with flexible links are disclosed and there are inlet and outlet ballast ports on both ends of the pipe.

During the construction phase of this reef all pipes will be fitted with closed ends as illustrated in FIG. 5 to create the maximum amount of buoyancy. Referring to FIG. 7, connecting clamps 200 comprise an upper section 210 and a lower section 220 which are connected by nut and bolt fasteners 250A 250B and 250C extending through openings in respective first upper exterior lip 212 to first lower exterior lip 222 and an opposite set of nut and bolt fasteners 252A, 252B and 252C extending through openings in respective second upper exterior lip 232 to second lower exterior lip 242. Sandwiched between the lips is a connecting plate 260 with openings 262A, 262B and 262C adjacent one end to receive a set of nut and bolt fasteners and openings 264*a*, 264*b* and 264*c* (see FIG. 5) adjacent an opposite end to receive a second set of nut and bolt fasteners. A clamp 200 is wrapped around a pipe 20 so that its upper section 210 and lower section 220 enclosed a portion of the surface of a pipe 20 and are fastened around the pipe 20 by fastening members 250A, 250B, 250C, 252A, 252B and 252C. An adjacent clamp is fastened around an adjacent pipe and similarly fastened. The connecting plate has a length L3 so that a given space is formed between two adjacent connecting pipes which space is approximately the distance L3 from oppositely disposed openings. A multiplicity of such clamps is fastened around spaced apart locations along the length of the pipes 20 of each section 40, 50 and 60 with adjacent section of pipe separated by the distance L3 of the connecting plate 260. Connecting clamps 200 would be installed in calm water within a harbor. In this initial assembly phase, the assembled reef 10 would look like a log/pipe raft with most or all pipe elements floating on the water's surface. The ability to "float" the pipes into position during the construction phase, in protected water, greatly reduces material handling costs. Assembly of the reef in a controlled environment such as a harbor also greatly reduces construction impacts on environmentally fragile shoreline locations.

Once assembly is complete, the reef "raft" is towed to location.

The installation includes placing anchors 70 fastening points to the bottom.

The inherent flexibility of HDPE 20 pipe and the flexibility built into the pipe connection system allow the individual elements and complete assembly to absorb/react to the forces exerted on it in the ocean environment. The flexibility and modularity of the connecting clamps 250 allow the entire structure to share the forces acting upon it. This "load sharing" is a key quality of the new reef structure. Highly concentrated loads such as a wave breaking on the reef structure are dispersed throughout the structure by virtue of the bending of the HDPE pipe 20 and the elongation and compression of the flexible linking elements 260. The nature of the design of the connecting clamps 200 adds hoop strength to the HDPE pipes 20 at the connection points. This reduces the tendency of a pipe to collapse or flatten under bending loads. Inclusion of connecting links 260 of various shapes and/or lengths and/or compression struts between pipes and the natural HDPE pipe's flexibility allows manipulation of the pipe elements to non-linear or curved forms. This ability greatly increases design adaptability to location and conditions as well as overall strength.

Figure 3:
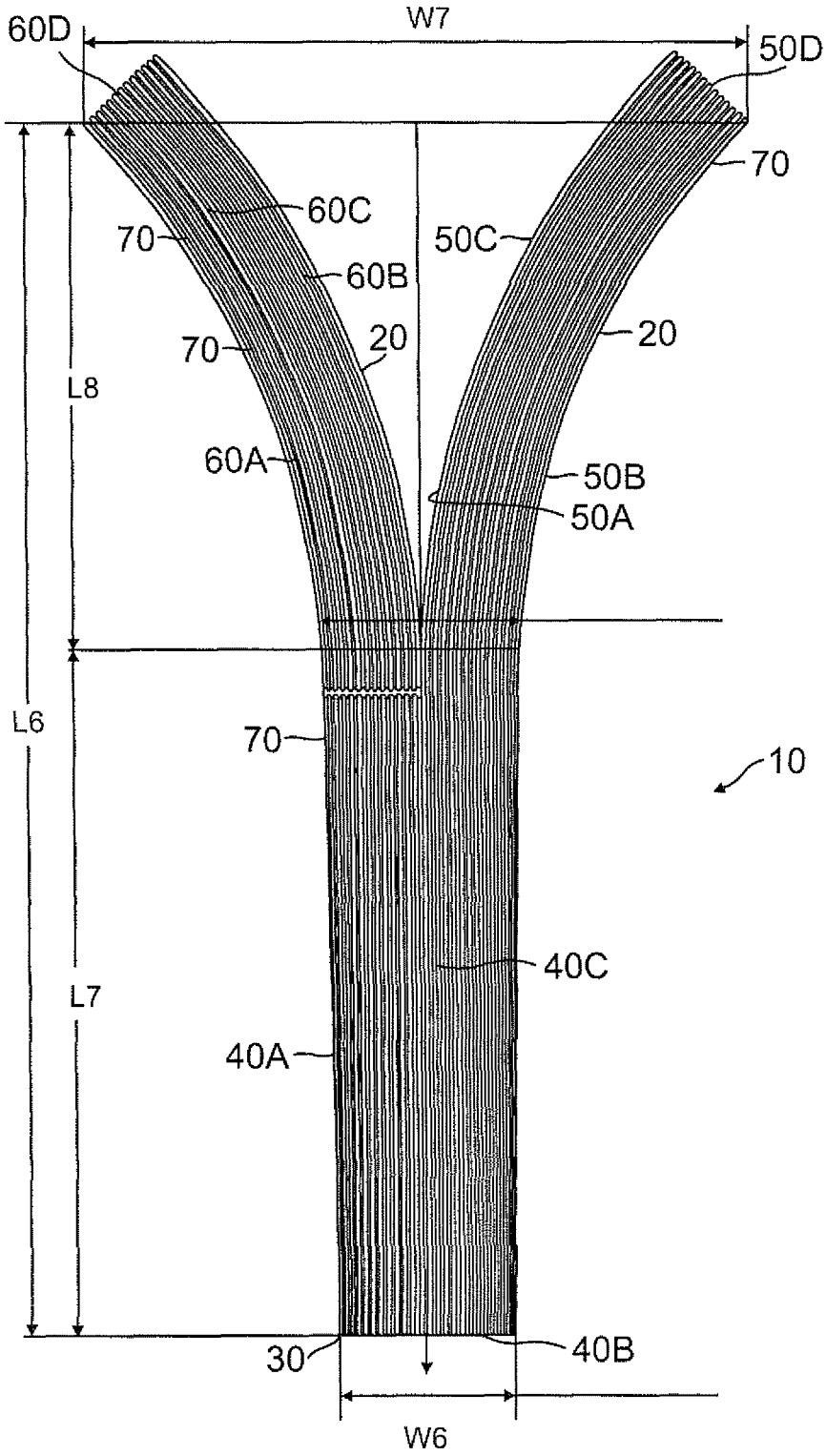
FIG. 3 is a top plan view of a preferred embodiment of the present invention shoreline erosion mitigation device.
Figure 4:
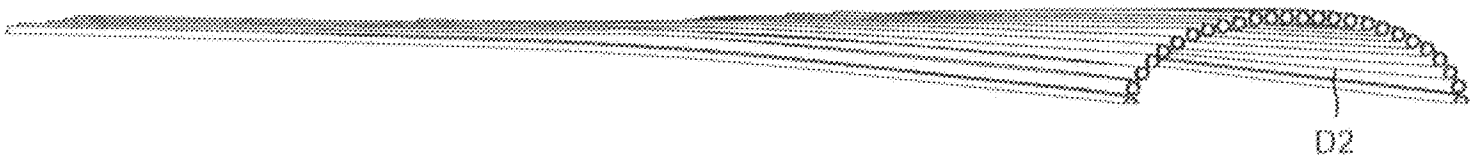
FIG. 4 is a perspective view of the leading straight edge of a preferred embodiment of the present invention shoreline erosion mitigation device with a line representing sea level.

It is known that in order to encourage ocean waves to break, the size of an artificial reef 10 is critical. In general, the larger the reef, the more control over wave action any design will have. In addition, the larger the reef, the more likely that waves having more or larger wavelengths will be affected by the reef. The ability to cost effectively add to the size and/or modify the shape of an artificial reef vastly increases its potential to control or modify ocean waves. The modular design of this reef makes it intrinsically scalable. Scalability increases efficacy and also intrinsically lowers cost during both the design and construction phases. Referring to FIG. 3, by way of example, the entire length L6 of the reef 10 can be approximately 251 feet, the length L7 of the first section 40 can be approximately 196 feet, the length L8 of the divergent sections 50 and 60 can be approximately 154 feet. The width "W6" of the leading edge of first section 40 can be approximately 51 feet and the width "W7" of the extreme ends of the divergent sections 50 and 60 can be approximately 194.5 feet. It will be appreciated that these are just illustrative dimensions examples and the reef 10 can be any desired dimension.

Permeability is a fundamental element of this new art. The principal this new reef utilizes is similar to that of a snow or sand fence. The flow of wind carrying sand or snow is slowed down and redirected by a "permeable" fence to encourage accretion of snow or sand around the fence. Reef permeability and shape of the pipe elements in this new reef structure function in much the same way.

Permeability is achieved by fastening HDPE pipes together with a space L3 between them. Permeability offers the advantage of increased surface area not directly exposed to ocean forces. This means any force acting on the structure is dispersed over a larger area equating to lower force per unit area.

The circular cross section of pipe 20 tends to disperse or re-direct forces from any given vector. Flow around a pipe slows down as it passes the pipe and changes direction to random vectors. Sediment carried in the decreasing flow precipitates or falls to the ocean bottom within the reef structure.

A primary function of this new art is to accrete sediment within its structure. Sediment accretion adds to the stability of the reef structure and its effectiveness to encourage ocean waves to break offshore.

In locations where sand is not available for accretion, the reef's permeability and cylindrical pipe form elements are used primarily for energy absorption and distribution throughout the structure. Without permeability effective sand accretion and efficient load sharing would not be possible.

The pipes 20 have a hollow interior 22 into which water or heavier objects such as sand can be placed. Each end of a pipe can be sealed with a cap or ballast port 24

As described above, portability facilitates construction, transport and placement of the new reef. An additional benefit of this portable reef design is that it can be easily removed or relocated. The ability to increase buoyancy by removing sand ballast from within the pipes through the use of pumps, allows the entire structure to be re-floated and moved. A beach can be widened or "built" by simply moving the reef structure a short distance farther seaward as sediment accretes within the structure.

Portability also allows quick reef instillation to protect threatened structures during emergencies.

The design elements of this structure are not limited to ocean shoreline protection. The features and functions of this design can be used to mitigate erosion of river banks, levies, canals or any other body of water subject to shoreline erosion due to waves and/or current.

Figure 10:
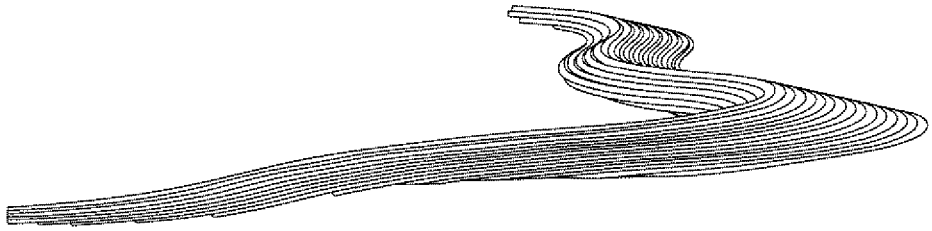
FIG. 10 is a perspective view of a first alternative embodiment of the present invention shoreline erosion mitigation device.
Figure 11:
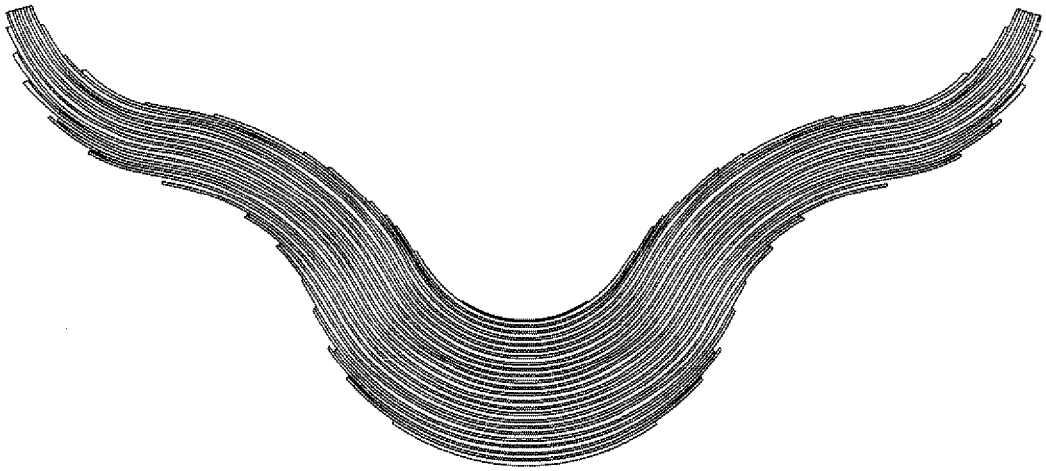
FIG. 11 is a perspective view of a second alternative embodiment of the present invention shoreline erosion mitigation device.
Figure 12:
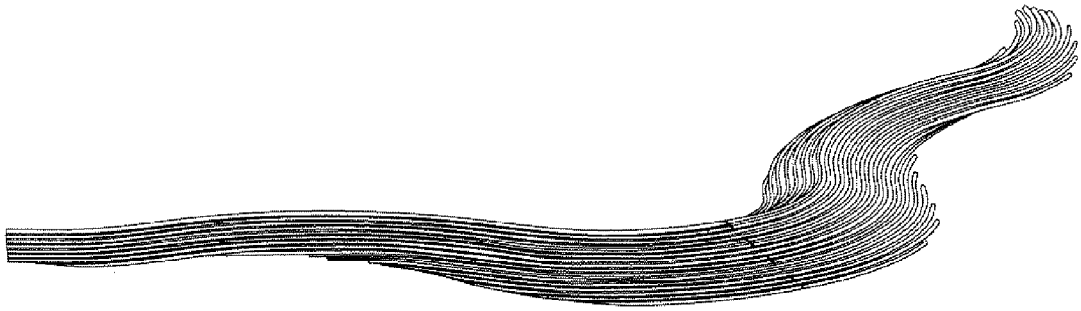
FIG. 12 is a perspective view of a third alternative embodiment of the present invention shoreline erosion mitigation device.
Figure 13:
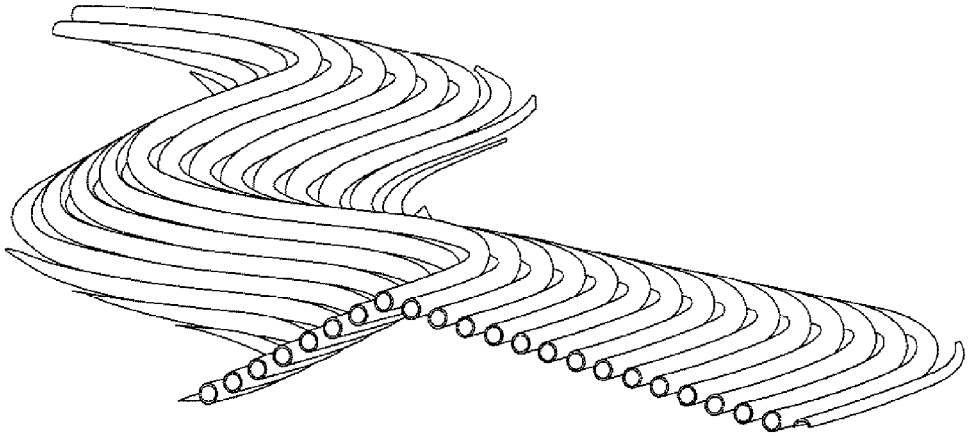
FIG. 13 is a perspective view of a fourth alternative embodiment of the present invention shoreline erosion mitigation device.

Any given location will have its own requirements for shoreline erosion mitigation. The modular nature of this design allows virtually any size or shape of reef to be designed to create the desired effect. Suggested plan forms might be "Y' shaped as illustrated in FIGS. 1 and 3 to encourage certain wave forms. Plan forms can be rectangular, triangular or crescent in shape. Non-linear or non-geometric shapes are also possible plan forms. Cross-sectional shapes can be anything from flat to circular to more organic or non-linear, non-geometric. A shape such as a manta ray or bat as illustrated in FIGS. 10, 11 and 12 or sinusoidal as illustrated in FIG. 13 are also within the spirit and scope of the present invention.

The design of fastening point grids in the ocean floor can be arranged to impart both plan form and cross sectional shape.

Cables and/or struts fastened between reef structure elements can be used to control shape and functional qualities.

As a wave comes towards a shoreline, the wave hits the front or leading edge 40D of leading leg section 40 and the force of the wave is distributed over the top surfaces 40C, 50C and 60D of the reef sections 40, 50 and 60 and partially fall through the gaps between the pipes 20 and are caused to be redirected in the direction of the divergent leg sections 50 and 60 to thereby substantially reduce the force of the wave as it comes ashore, thereby substantially reduce beachfront or waterfront erosion.

During the construction phase of this reef, all pipes will be fitted with closed ends to create the maximum amount of buoyancy. Connecting clamps would be installed in calm water within a harbor. In this initial assembly phase, the assembled reef would look like a log/pipe raft with most or all pipe elements floating on the water's surface. The ability to "float" the pipes into position during the construction phase, in protected water, greatly reduces material handling costs. Assembly of the reef in a controlled environment such as a harbor also greatly reduces construction impacts on environmentally fragile shoreline locations.

Once assembly is complete, the reef "raft" is towed to location.

The instillation phase includes placing anchors or fastening points to the bottom, positioning the floating reef assembly through the use of tugs and temporary lines or cables, attachment to fastening points and buoyancy adjustment.

Fastening point locations and buoyancy adjustment will determine the final cross sectional and plan form of the reef. These operations will take into consideration the bottom structure, waves and currents and other natural environmental factors Buoyancy variability simplifies construction, transport and placement of this new reef. Inexpensive assembly, materials, standardized fastening system and shape adjustability insure efficacy with remarkably low cost and quick, low impact construction.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A shoreline erosion mitigation device placed in a body of water, comprising:

a. a multiplicity of HDPE (high density polyethylene) pipes each of a given length and diameter with each pipe being generally cylindrical in shape and having a hollow interior, the multiplicity of HDPE pipes arranged in approximately parallel rows with adjacent pipes connected together by a system comprising clamps and flexible links, which leaves a space between adjacent HDPE pipes so that by increasing or decreasing at least one of the number of HDPE pipes, the length of the HDPE pipes, the diameter of the HDPE pipes and the number of clamps, a design of the device is adjusted to accommodate differing shoreline conditions; and b. the device formed into three sections with a leading leg section having a leading edge and extending at its portion remote from the leading edge to a pair of divergent leg sections, the leading leg section and divergent leg sections each formed into an arcuate shape through connection of the clamps and flexible links, the device anchored to a floor of the body of the water at a given distance from a shoreline so that the device rests below a surface of the body of water, the leading edge of the device facing away from the shoreline;

c. whereby, upon an occurrence of a wave having a given force traveling from the body of water towards the shoreline encounters the device, the force of the wave is reduced when the wave breaks with the effect or redirection of the wave in a direction of the divergent leg section on the device so that the energy of the wave is dissipated with the breaking of the wave and the wave energy is significantly reduced by the time the wave reaches the shoreline.

2. The device in accordance with claim 1 wherein the device is a reef with its leg sections being modular in nature so that the reef is scaled and engineered to meet design requirements of any location in the body of water.

3. The device in accordance with claim 1 wherein each HDPE pipe has a diameter between 12 inches and 26 inches, the arcuate shape of each leg section having a diameter of approximately 50 feet and a height of approximately 25 feet.

4. The device in accordance with claim 1 wherein each end of each HDPE pipe is open so that the HDPE pipes are filled with ballast.

5. The device in accordance with claim 1 wherein at least some of the HDPE pipes are filled with ballast and sealed at the ends of the at least some of the HDPE pipes to retain the ballast within the at least some of the HDPE pipes.

6. The device in accordance with claim 1 wherein at least some of the HDPE pipes are entirely filled with air and sealed at the ends of the at least some of the HDPE pipes to retain the air within the at least some of the HDPE pipes.

7. The device in accordance with claim 1 wherein at least some of the HDPE pipes are partially filled with air and partially filled with ballast and sealed at the ends of the at least some of the HDPE pipes to retain the ballast and air within the at least some of the HDPE pipes.

8. The device in accordance with claim 1 further comprising:

a. each clamp is comprised of an upper section and a lower section which are connected by nut and bolt fasteners extending through openings in a respective first upper exterior lip to a first lower exterior lip and an opposite set of nut and bolt fasteners extending through openings in a respective second upper exterior lip to a second lower exterior lip, the first and second upper exterior lips and first and second lower exterior lips being oppositely disposed and extending away from the clamp sections;

b. sandwiched between each set of upper and lower exterior lips is a connecting plate with respective openings adjacent oppositely disposed ends to receive a set of bolts fastened by nuts;

c. a respective clamp wrapped around each respective HDPE pipe so that the upper section and lower section of the clamp enclose a portion of a surface of an HDPE pipe and are fastened around the HDPE pipe by fastening bolts and nuts extending through respective openings adjacent an opposite edge of the connecting plate;

d. the connecting plate having a given length to thereby provide a space between adjacent HDPE pipes; and e. a multiplicity of such clamps are fastened around spaced apart locations along the length of the HDPE pipes.

9. The device in accordance with claim 1 wherein the HDPE pipes are tethered together to create a floating raft that is attached to the floor of the body of water to become an offshore reef structure.

10. The device in accordance with claim 1 wherein the HDPE pipes are tethered to the bottom of the body of water by an anchoring system.

11. The device in accordance with claim 1 wherein the device is an underwater arch of any desired radius, length and width.

12. A shoreline erosion mitigation device placed in a body of water, comprising:

a. a multiplicity of HDPE pipes each of a given length and diameter with each pipe being generally cylindrical in shape and having a hollow interior, the multiplicity of pipes arranged in approximately parallel rows with adjacent pipes connected together by a system using clamps and flexible links, so that by increasing or decreasing at least one of the number of HDPE pipes, the length of the HDPE pipes, the diameter of the HDPE pipes and the number of clamps, the design of the device is adjusted to accommodate differing shoreline conditions; and b. the device formed with a leading leg section having a leading edge and extending at the leading leg portion remote from the leading edge to divergent leg sections, the leading leg section and divergent leg sections each formed into an arcuate shape through connection of the clamps and flexible links, the device anchored to a floor of the body of the water at a given distance from a shoreline so that the device rests below a surface of the body of water, the leading edge of the device facing away from the shoreline;

c. whereby when a wave having a given force traveling from the body of water towards the shoreline encounters the device, the force of the wave is reduced by causing the water to travel over the device and around the multiplicity of pipes so that the force of the wave is significantly reduced by the time the wave reaches the shoreline.

13. The device in accordance with claim 12 wherein the device is a reef with the leg sections being modular in nature so that the reef is scaled and engineered to meet design requirements of any location in the body of water.

14. The device in accordance with claim 12 wherein each pipe has a diameter between 12 inches and 26 inches, the arcuate shape of each leg section having a diameter of approximately 50 feet and a height of approximately 25 feet.

15. The device in accordance with claim 12 wherein each end of each pipe is open so that the HDPE pipes are filled with ballast.

16. The device in accordance with claim 12 wherein at least some of the pipes are filled with ballast and sealed at the ends of the at least some of the pipes to retain the ballast within the at least some of the pipes.

17. The device in accordance with claim 12 wherein at least some of the pipes are entirely filled with air and sealed at the ends of at least some of the pipes to retain the air within the at least some of the pipes.

18. The device in accordance with claim 12 wherein at least some of the pipes are partially filled with air and partially filled with ballast and sealed at the ends of the at least some of the pipes to retain the ballast and air within the pipes.

19. The device in accordance with claim 12 further comprising:

a. each clamp is comprised of an upper section and a lower section which are connected by fastening members extending through openings in a respective first upper exterior lip to a first lower exterior lip and an opposite set of fastening members extending through openings in a respective second upper exterior lip to a second lower exterior lip, the first and second upper exterior lips and the first and second lower exterior lips being oppositely disposed and extending away from the upper and lower clamp sections;

b. sandwiched between each set of upper and lower exterior lips is a connecting plate with respective openings adjacent oppositely disposed ends to receive a set of fastening members;

c. a respective clamp wrapped around each respective pipe so that the upper section and lower section of each respective clamp enclose a portion of a surface of the pipe and are fastened around the pipe by fastening members, a respective pair of clamps attached adjacent opposed ends of the connecting plate located between two adjacent pipes;

d. the connecting plate having a given length to thereby provide a space between adjacent pipes; and e. a multiplicity of such clamps are fastened around spaced apart locations along the length of the pipes.

20. The device in accordance with claim 12 wherein the pipes are tethered together to create a floating raft that is attached to the floor of the body of water to become an offshore reef structure.

21. The device in accordance with claim 12 where the pipes are tethered to a bottom of the body of water by an anchoring system.

22. The device in accordance with claim 12 wherein the device is an underwater arch of any desired radius, length and width.

23. The device in accordance with claim 12 wherein the shape of the device is selected form the group consisting of Y-shaped, manta ray shaped, bat shaped and sinusoidal.

24. The device in accordance with claim 12 where there is no gap between adjacent pipes.

25. The device in accordance with claim 12 where there is a gap between adjacent pipes.

* * * * *